United States Patent [19]

Seifert

[11] Patent Number: 4,730,785

[45] Date of Patent: Mar. 15, 1988

[54] FUEL INJECTION NOZZLE FOR INTERNAL COMBUSTION ENGINES

[75] Inventor: Kurt Seifert, Esslingen-Zollberg, Fed. Rep. of Germany

[73] Assignee: Robert Bosch GmbH, Stuttgart, Fed. Rep. of Germany

[21] Appl. No.: 25,151

[22] PCT Filed: Mar. 26, 1986

[86] PCT No.: PCT/DE86/00127

§ 371 Date: Dec. 5, 1986

§ 102(e) Date: Dec. 5, 1986

[87] PCT Pub. No.: WO86/06441

PCT Pub. Date: Nov. 6, 1986

[30] Foreign Application Priority Data

May 2, 1985 [DE] Fed. Rep. of Germany ..... 3515723

[51] Int. Cl.[4] ..... F02M 61/08; F02M 61/16

[52] U.S. Cl. ..... 239/453; 239/533.3; 239/533.12

[58] Field of Search ..... 239/533.12, 533.2, 533.3, 239/533.4, 533.5, 533.9, 453, 452

[56] References Cited

U.S. PATENT DOCUMENTS 4,531,676 7/1985 Seifert et al. ..... 239/533.12
4,572,434 2/1986 Seifert ..... 239/533.12

FOREIGN PATENT DOCUMENTS 0084662 8/1983 European Pat. Off. .
2289756 5/1976 France .
8402379 6/1984 PCT Int'l Appl. .
2023228 12/1979 United Kingdom .
2099077 12/1982 United Kingdom .

*Primary Examiner*—Andres Kashnikow
*Assistant Examiner*—Karen B. Merritt
*Attorney, Agent, or Firm*—Michael J. Striker

[57] ABSTRACT

Fuel injection nozzle for internal combustion engines, which includes a valve needle connected with a piston which limits a dampening chamber filled with fuel and connected with only one throttle passage with the flow path of the fuel. The dampening chamber is formed in a cap which is mounted on the piston. A pressure piece which is loaded by the fuel is guided in the bottom of the cap. The pressure piece pushes immediately against the piston during a prestroke and then comes into engagement with the cap. The pressure piece has a smaller diameter than that of the piston, so that the prestroke of the valve needle is more or less dampened at least at its lower speed and load range.

4 Claims, 5 Drawing Figures

FUEL INJECTION NOZZLE FOR INTERNAL COMBUSTION ENGINES

BACKGROUND OF THE INVENTION

The invention relates to a fuel injection nozzle for internal combustion engines.Injection nozzles of this type have the advantage that the opening stroke of the valve needle is performed in a damping manner. By a corresponding coordination of the throttle passage and a return spring of the cap it can be achieved that the dampening in certain ranges of the operating performance graph is only effective over a partial stroke of the valve needle. The pressure piece which is displaceably mounted in the bottom of the cap transmits the fuel pressure directly to the piston during a prestroke and through this piston to the valve needle. Thereby, it is achieved that a prestream of a sufficiently large fuel amount is injected at the start of each injection operation.

In a known injection nozzle of this type (DE-Al 33 07 671) the pressure piece has the same diameter as the piston which is connected with the valve needle. In this embodiment it is easy to work the bore in the cap, however the prestroke of the valve needle performs practically undampened. In many cases this may undesirably influence the dampening effect of the subsequent partial stroke or may result in certain ranges of the operating performance graph in an unfavorable ratio of the preinjection amount with respect to the main injection amount.

SUMMARY OF THE INVENTION

It is an object of the present invention to provide a fuel injection nozzle in which the prestroke of the valve needle is performed at least partially dampened in the lower speed and load range. By the adjustment of the diameter of the pressure piece and the piston to the throttle passage which leads into the dampening chamber (bearing play of the pressure piece and the piston) it can be achieved that the total opening stroke of the valve needle is limited to the magnitude of the prestroke during the idle running of the engine. By a corresponding dimensioning of the return spring of the pressure piece and its mounting slot it can be achieved that the pressure piece does not reach its initial position in the injection intervals when it engages on the piston, so that the prestroke also operates at least partially undampened. Such an injection operation may be particularly advantageous with high speeds and during a full load for a rapid injection of a large amount of fuel.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
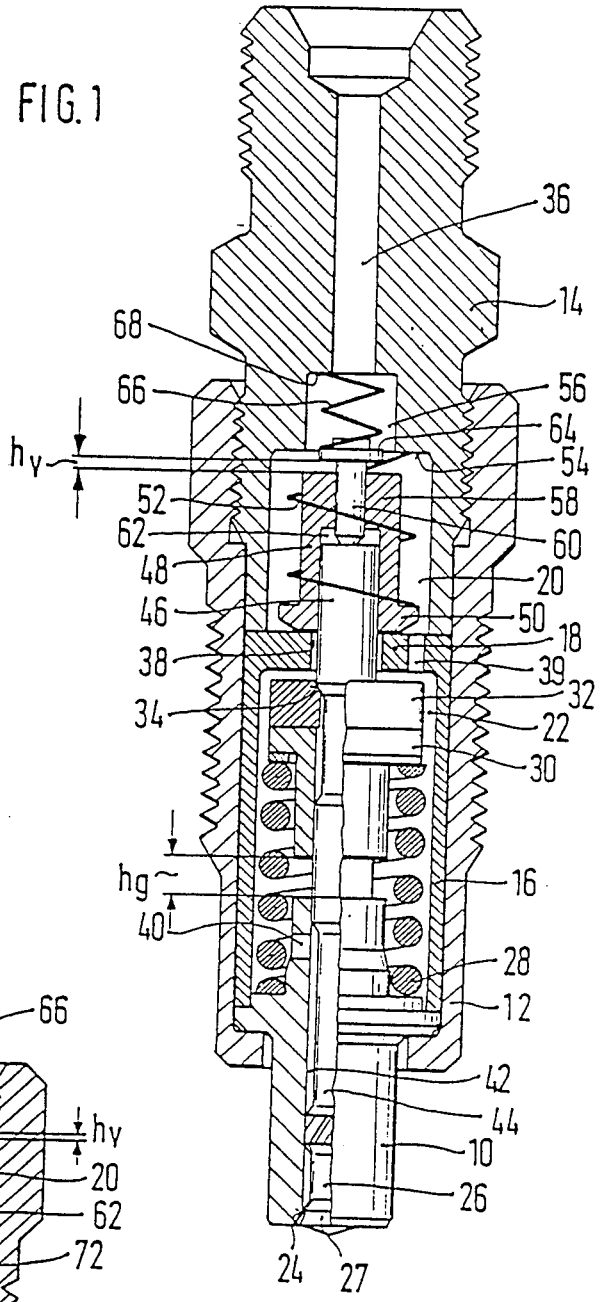
FIG. 1 is an elevated sectional view of the first exemplified embodiment in a longitudinal section.

The injection nozzle shown in FIG. 1 has a nozzle element 10 which is clamped to a nozzle support 14 by means of a screw cap 12. A socket 16 is provided between the nozzle element 10 and the nozzle support 14, which has an inwardly directed collar 18 which socket separates a chamber 20 from a chamber 22. A valve seat 24 is formed in nozzle element 10 and a valve needle 26 is displaceably mounted, whose stuffing cone 27 is pushed by a locking spring 28 against the valve seat 24. The locking spring 28 is supported on nozzle element 10 and engages by means of a flange part 30 a support disk 32 which in turn is supported on a shoulder 34 of the valve needle.

The nozzle support 14 has a feeding bore 36 which discharges into chamber 20 which is connected with chamber 22 by means of bores 38,39 in collar 18. From there a bore 40 in nozzle element 10 feeds into an annular chamber 42 which is formed between the central bore wall of the nozzle element 10 and the peripheral circumference of a segment 44 of the valve needle 26 being weakened in its diameter and which extends immediately to the proximity of the valve seat 24. A distance $h_g$ is present between the flange part 30 and the nozzle element 10 in the illustrated locking position which corresponds to the total stroke of the valve needle 26. The valve needle 26 is displaced outwardly in the direction of opening by the fuel pressure against the force of locking spring 28 until the flange part 30 abuts against nozzle element 10. During the locking of the valve the locking spring 28 retracts the valve needle inwardly into the illustrated locking position.

A piston 46 is formed of one piece and is tipstretched on the valve needle 26 above shoulder 34, piston 46 extending through collar 18 and protruding into chamber 20. The diameter of piston 46 corresponds to the guide diameter of valve needle 26. A cap 48 with a predetermined radial clearance is mounted on piston 46 and has a flange edge 50. Cap 48 is pushed by a return spring 52 against collar 18. Thereby, the return spring 52 is supported on an annular shoulder 54 of the nozzle support 14 which is formed at the transition of chamber 20 into an expanded portion 56 of supply bore 36.

Cap 48 has a bottom 58 in which a pressure piece 60 is displaceably mounted, which has a smaller diameter than piston 46. A dampening chamber 62 filled with fuel is formed in cap 48 between the front face of piston 46 and bottom 58, which chamber is connected with chambers 20,22 and thereby with the flow path of the fuel through the bearing plays of piston 46 and the pressure piece 60. At the bottom the pressure piece 60 extends into the dampening chamber 62 and is provided at its upper end with an annular collar 64 at which a return spring 66 engages which spring is supported on an annular shoulder 68 of the nozzle support 14.

In the illustrated initial position the pressure piece 60 engages on piston 46, whereby its annular collar 64 is speed from the upper front face of cap 48 by a distance $h_v$. In this case the distance $h_v$ corresponds to a prestroke of the valve needle, whereby the valve needle should by subjected to a weaker dampening in a defined range of the operating performance graph than in the remaining stroke.

The injection nozzle in accordance with FIG. 1 operates as follows:

At the start of an injection operation the parts assume the position illustrated in FIG. 1, whereby the dampening chamber 62 has its smallest volume. The increasing fuel pressure is now fully effective and acts through pressure piece 60 in a throttling manner on the annular face of the piston 46, which is not covered by the pressure piece. Thus, the valve needle 26 is displaced in the opening direction until the pressure piece 60 comes into engagement with cap 48 after reversing of the prestroke $h_v$.

Figure 3:
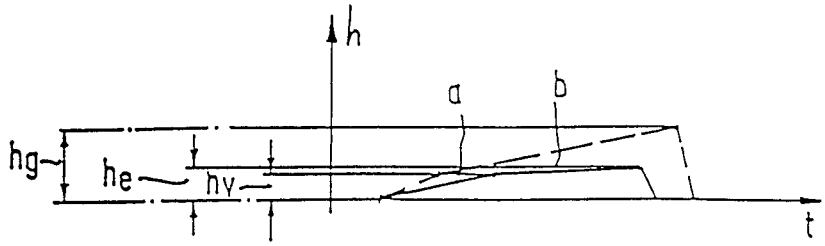
FIGS. 3, 4 and 5 illustrate functional graphs of the injection nozzles illustrated in FIGS. 1 and 2 respectively.

The operational diagram in accordance with FIG. 3 which illustrates the valve needle stroke h during the injection duration t is illustrated by the partial path a. Because the dampening chamber 62 enlarges during this operation, the movement of the valve needle 26 is slower than in the known device, wherein the pressure piece 60 has the same diameter as the piston 46 and wherein an enlargement of the dampening chamber 60 does not occur during the prestroke.

After the engaging of the pressure piece 60 onto the cap 48 which is fixedly mounted on the housing only the fuel pressure in the dampening chamber 62 acts on the valve needle, which results in a stronger dampening of the further needle movement than before. This operation is illustrated in FIG. 3 by the partial path 6 which extends flatter than partial path a. Depending on the point of operation an end stroke $h_e$ of the valve needle is obtained which corresponds to the total stroke $h_g$ during full load and high speed. This point of operation is indicated by the dotted lines in FIG. 3.

Figure 4:
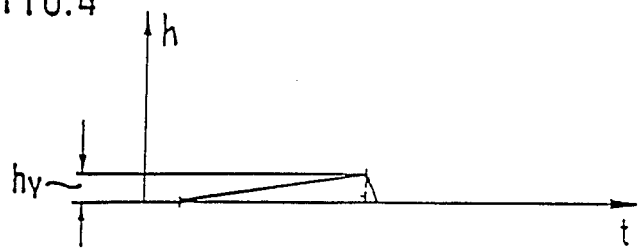

At the end of the injection operation the locking spring 28 moves the valve needle 26 upwardly into the locking position, whereby the cap 48 together with the pressure piece 60 is lifted back into its inital position by its return spring 52 in accordance with the throttling effect in the bearing plays of piston 46 and the pressure piece 60. Avantageously, in the idle operation the valve needle 26 can only execute the prestroke $h_v$ as illustrated in the diagram in accordance with FIG. 4.

Figure 2:
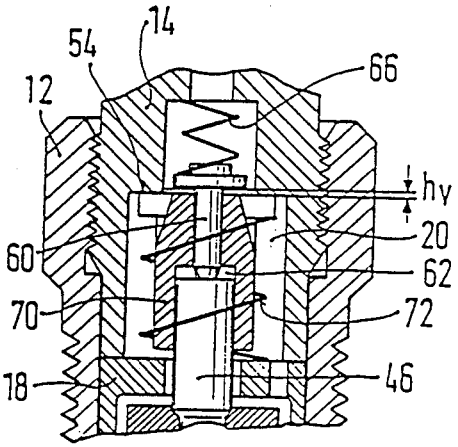
FIG. 2 a partial longitudinal section through the second exemplified embodiment.

The injection nozzle in accordance with FIG. 2 deviates from the one of FIG. 1 only in that a cap 70 which is mounted on piston 46 is supported by means of a pretensioned support spring 72 on collar 18 which spring is fixedly mounted on the housing, whereby the annular shoulder 54 of the nozzle support 14 limits the cap 70 in its upward movement.

The pressure piece 60 acts immediately on piston 46 during a prestroke $h_v$, as described with respect to the aforementioned embodiment, and thereafter comes into engagement with cap 70. During a further increase of the fuel pressure the pressure differential increases between the dampening chamber 62 and the chamber 20, while the cap 70 cannot initially follow the movement of the valve needle 26 because of the action of the pretensioned support spring 72. The support spring 72 is so designed that its pretension is not overcome during its idle speed and in the average speed range, so that the dampening is effective over the total needle stroke.

Figure 5:
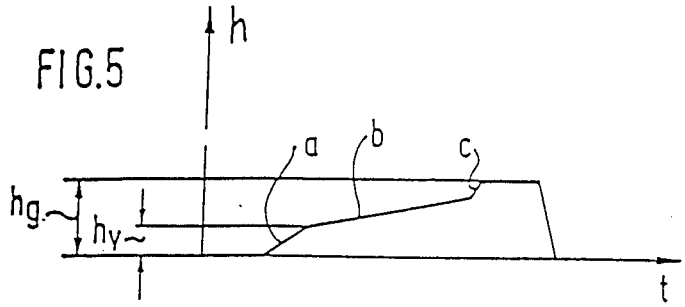

In the upper speed and load range the pressure differential between the chamber 20 and the dampening chamber 62 increases to such an extent that the pretension of the support spring 72 is overcome. Subsequently, cap 70 follows the valve needle 26 by compressing the support spring 72, so that the dampening effect is substantially released. Thereby, the valve needle 26 is rapidly moved into the full opening position which is illustrated in the diagram of FIG. 5 by the partial path c. The dampening effect can be limited pressure dependent to a desired amount by the corresponding selection or setting of support spring 72.

It will be understood that each of the elements described above, or two or more together, may also find a useful application in other types of fuel injection nozzles for internal combstion engines differing from the types described above.

While the invention has been illustrated and described as embodied in a fuel injection nozzle for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Fuel injection nozzle for internal combustion engines, comprising a valve needle which is movable during an opening stroke in the fuel flow direction; a piston which is connected to said valve needle; a cap having a shoulder and mounted on said piston and formed with a damping chamber limited by said piston and filled with fuel, said dampening chamber being connected with a flow path of the fuel by only a throttle passage, said cap being retained at least in a defined range of the operating performance graph with respect to the movable valve needle; a pressure piece which is displaceably mounted in said cap; a return spring, said pressure piece at a side thereof which faces away from said dampening chamber being loaded by said return spring and by fuel pressure in the flow path, said pressure piece engaging on the piston at the start of an opening stroke and coming into engagement on said shoulder of said cap for preventing its further movement after a prestroke of the valve needle, said pressure piece (60) being mounted in a bottom of said cap (48, 70) and having a smaller diameter than that of the piston (46).

2. Fuel injection nozzle in accordance with claim 1, further including a housing having a housing shoulder (18) and further including a further return spring, said cap (48) being pushed against said housing shoulder (18) by said further return spring (52) in the direction of an opening movement of said valve needle (26).

3. Fuel injection nozzle in accordance with claim 1, further including a housing having a housing shoulder (18) and a counter shoulder (54), and a pretensioned support spring (72), said cap (70) being supported on said housing shoulder (18) by means of said pretensioned support spring (72), and a pretension force of the support spring (72) being absorbed on said counter shoulder (54) of said housing (14).

4. Fuel injection nozzle in accordance with claim 1, wherein throttle passages opening into the dampening chamber (62) are formed by bearing plays of said piston (46) and pressure piece (60).

* * * * *